US010903558B1

(12) United States Patent
Medeiros

(10) Patent No.: US 10,903,558 B1
(45) Date of Patent: Jan. 26, 2021

(54) TOP FED WIDEBAND DUAL PITCH QUADRIFILAR ANTENNA

(71) Applicant: The United States of America as represented by the Secretary of the Navy, Newport, RI (US)

(72) Inventor: Paul Medeiros, Middleboro, MA (US)

(73) Assignee: The United States of America as represented by the Secretary of the Navy

( * ) Notice: Subject to any disclaimer, the term of this patent is extended or adjusted under 35 U.S.C. 154(b) by 55 days.

(21) Appl. No.: 16/394,021

(22) Filed: Apr. 25, 2019

(51) Int. Cl.
*H01Q 1/36* (2006.01)
*H01Q 21/28* (2006.01)
*H01Q 11/08* (2006.01)

(52) U.S. Cl.
CPC ..... *H01Q 1/362* (2013.01); *H01Q 11/08* (2013.01); *H01Q 21/28* (2013.01)

(58) Field of Classification Search
CPC ..... H01Q 1/362; H01Q 11/08; H01Q 21/28
USPC ..... 343/895
See application file for complete search history.

(56) References Cited

U.S. PATENT DOCUMENTS 3,761,937 A * 9/1973 Tricoles ..... H01Q 15/00 343/770
6,112,102 A 8/2000 Zhinong
6,344,834 B1 2/2002 Josypenko
6,545,649 B1 4/2003 Seavey
6,653,987 B1 * 11/2003 Lamensdorf ..... H01Q 1/38 343/853
8,514,144 B2 * 8/2013 Gray ..... H01R 24/50 343/892
2004/0008153 A1 * 1/2004 Lamensdorf ..... H01Q 11/08 343/895
2008/0024309 A1 * 1/2008 Balhoff ..... H01Q 1/38 340/572.8
2014/0253410 A1 * 9/2014 DiNallo ..... H01Q 1/362 343/895
2015/0116184 A1 * 4/2015 Curran ..... B29C 44/1271 343/872
2018/0076528 A1 * 3/2018 Tawk ..... H01Q 11/08
2018/0090829 A1 * 3/2018 McMichael ..... H01Q 9/145
2018/0090830 A1 * 3/2018 McMichael ..... H01Q 1/241
2018/0351243 A1 * 12/2018 Lewis ..... B64C 1/1446

* cited by examiner

*Primary Examiner* — Don P Le
(74) *Attorney, Agent, or Firm* — James M. Kasischke; Michael P. Stanley

(57) ABSTRACT

A top fed, wide band, dual pitch, quadrifilar helix antenna with hemispherical radiation pattern coverage with a reduced back lobe over a wide bandwidth is described wherein one end of the antenna's helix has a high pitch angle that adjoins the other end of the helix with a low pitch angle. The dual pitch angles provide stable radiation patterns and exceptional impedance response to support ultra-high frequency, ultra-high frequency follow-on and mobile user object system circuits. Broadband performance is further aided by providing a radome that dielectrically loads the antenna.

5 Claims, 4 Drawing Sheets

TOP FED WIDEBAND DUAL PITCH QUADRIFILAR ANTENNA

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention relates generally to broadband antennas and, more particularly, to a top fed, dual pitch quadrifilar helix antenna with hemispherical radiation pattern coverage having a reduced back lobe.

(2) Description of the Prior Art

Broadband helical antennas utilized for satellite communications bands may be mounted on the mast of a surface vessel or underwater vehicle for wideband satellite communications. Satellite communications may include ultra high frequency (UHF) and ultra high frequency follow-on (UFO) satellite communications. Presently, a common practice is to utilize two UHF quadrifilar helix antennas to provide hemispherical coverage to support UHF and UFO circuits. The two antennas are controlled by a switch mechanism in order to activate one antenna for high elevation angle coverage and the other for low elevation angle coverage. This common practice limits the vessel or vehicle by prohibiting satellite access to low or high elevation look angles at any given time.

FIG. 1 illustrates the geometry of a standard helical element 10 and identifies the standard parameters used to describe the geometry. Helical element 10 is wound about an axis 12 with a pitch spacing S. Pitch spacing S is the axial distance required for element 10 to make one full rotation or wrap around axis 12. Diameter D is the volute diameter of element 10 around axis 12. Element 10 is wrapped around axis with a pitch angle $\alpha$. Pitch angle $\alpha$ is the angle that element 10 makes perpendicular to axis 12. Mathematically, pitch angle $\alpha$ relates to spacing S and diameter D as follows:

$$\alpha = \tan^{-1}\left(\frac{S}{\pi D}\right) \tag{1}$$

A quadrifilar helical antenna has four of these elements. The elements are typically fed with equal amplitude and in phase quadrature distribution, ($1\angle 0°$, $1\angle 90°$, $1\angle 180°$, and $1\angle 270°$ (+/−) phase progression). The quadrifilar antenna can be fed at either end of the elements and can provide end fire or backfire radiation depending on the direction of phase progression and antenna polarization. It is known to provide these antennas with left and right hand circular polarization. End fire is the direction along the length of the antenna, and back fire is the direction opposite the length.

Quadrifilar helix antennas can be designed to shape and direct the main radiation lobe throughout the upper hemisphere by adjusting the element pitch angle, and/or the element diameter. Low pitch angle helical antennas tend to direct maximum radiation along the volute axis; for higher pitch angles, the maximum radiation intensity region is off-axis. Both the volute diameter and helical pitch angle can greatly influence the main lobe location as well as both pattern and impedance bandwidths.

The impedance bandwidth of a quadrifilar helix antenna typically increases with increasing volute diameter by effectively lowering the operational frequency cut-in point. However, as the circumferential length of the volute approaches one wavelength, the radiation pattern performance begins to degrade due to the introduction of multiple lobes.

Quadrifilar antennas are inherently prone to frequency scan, i.e., the main beam tends to scan down in elevation with increasing frequency, especially for high pitch angle quadrifilar helix antenna designs that exhibit maximum radiation intensity off-axis with respect to the antenna volute. Depending on the required frequency bandwidth and element length, this can limit the antenna's coverage capability. Additionally, quadrifilar helix antennas that contain short element lengths, i.e, fractional turn quadrifilar helix antennas, frequency scan is not as critical since the resonant structure produces a very broad beamwidth over a wide angular range. However, quadrifilar helix antennas that contain multi-turn and/or large element lengths can exhibit narrow beam widths, where frequency scan can become very critical.

With the advent of digital communications, there is a requirement for increased gain in antennas. Low gains result in more drop outs and needs for recommunication. Bit rates need to be lower in order to insure reception. Higher gain supports higher bit rate communication.

SUMMARY OF THE INVENTION

An object of the present invention is to provide an improved wideband satellite communication antenna that can replace the common practice of using multiple antennas.

Another object of the present invention is to provide a wideband satellite communication antenna to simultaneously access multiple satellites that reside within the low and high look angles.

Accordingly, a top fed, wide band, dual pitch, quadrifilar helix antenna with hemispherical radiation pattern coverage with a reduced back lobe over a wide bandwidth is described wherein one end of the antenna's helix has a high pitch angle that adjoins the other end of the helix with a low pitch angle. The dual pitch angles provide stable radiation patterns and exceptional impedance response to support ultra-high frequency, ultra-high frequency follow-on and mobile user object system circuits. Broadband performance is further aided by providing a radome that dielectrically loads the antenna.

Each of the four antenna filar elements comprises an outer planar surface portion which helically spirals around an antenna axis to define an outer cylindrical shape of the top fed quadrifilar helix antenna. The antenna filar elements may further comprise a pair of planar end surface portions at a feed end of the top fed quadrifilar helix antenna.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DESCRIPTION OF THE PREFERRED EMBODIMENT

Figure 1:
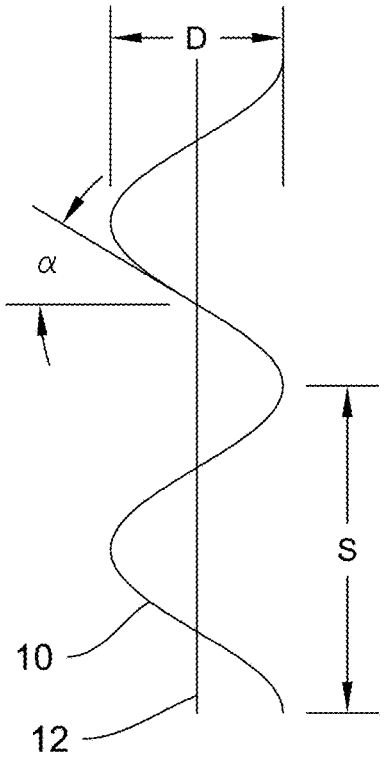
FIG. 1 illustrates the geometry of a standard helical element and identifies the standard parameters used to describe the geometry.
Figure 2:
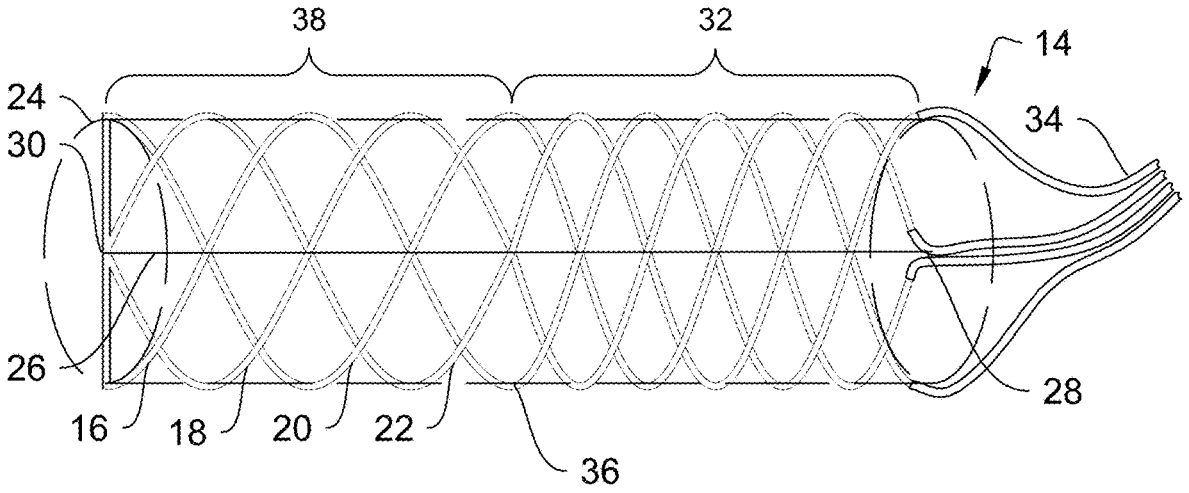
FIG. 2 is a perspective view, partially in hidden lines, of a top fed quadrifilar antenna in accord with one possible embodiment of the invention.

Referring now more particularly to FIG. 2, there is shown quadrifilar helix antenna 14. The quadrifilar helix antenna 14 has four individual filar elements 16, 18, 20 and 22 made from an electrically conductive material. Each of the individual filar elements 16, 18, 20 and 22 is arranged in a helical configuration around a cylindrical mandrel 24. Mandrel 24 is shown with dashed lines, so that the structure of the element 16, 18, 20 and 22 is visible. Mandrel 24 can be made from any dielectric material. In one embodiment, fiberglass is used for mandrel 24. The individual filar elements 16, 18, 20 and 22 are equally spaced relative to a normal axis 26 of mandrel 24. Elements 16, 18, 20 and 22 are joined to a feed at first end 28 of antenna 14. Filar elements 16, 18, 20 and 22 are shorted together at second end 30 of antenna 14.

Each individual filar element 16, 18, 20 and 22 is wrapped around the mandrel 24 utilizing two distinct pitch angles relative to the normal axis 26. In a first section 32, filar elements 16, 18, 20 and 22 are joined to an antenna feed 34 at first end 28. Filar elements have a low pitch angle $\theta_1$ which is maintained throughout first section 32. In a second section 38 of the antenna 14, beginning at transition point 36, filar elements 16, 18, 20 and 22 have a high pitch angle $\theta_2$. High pitch angle $\theta_2$ is maintained throughout second section 38. The transition point 36 is located along the length of antenna 14 such that, combined with the two distinct pitch angles $\theta_1$ and $\theta_2$, the effect is to provide a wide band, low back lobe, hemispherical radiation pattern performance characteristics.

This describes a discrete dual pitch antenna which is distinguished from a variable pitch antenna because the pitch changes discretely at transition point 36 rather than transitioning along the length of the antenna. It is believed that a discrete dual pitch antenna gives greater bandwidth because the discontinuity in pitch angle creates a perturbation in current flow that broadens the bandwidth.

Figure 3:
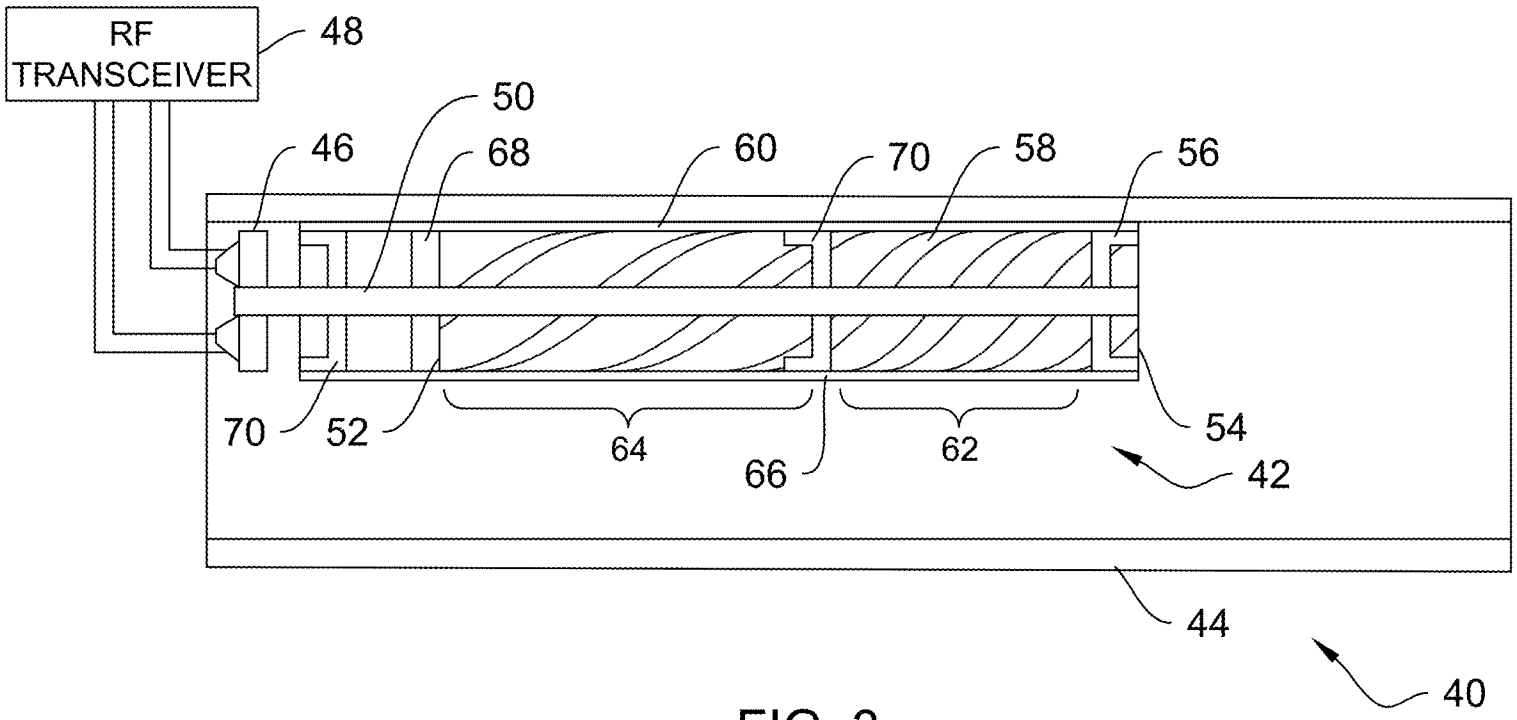
FIG. 3 illustrates a cross sectional view of the antenna of the present invention implemented as part of the communication system.

Referring to FIG. 3 there is illustrated a partially cross sectional view of an antenna assembly 40 incorporating the ideas set forth herein. Antenna assembly 40 includes an antenna 42 positioned within a radome 44. Antenna 42 is joined to a quadrature network 46 which is in turn joined to an RF transceiver 48. Quadrature network 46 adapts transmitted and received signals to and from antenna 42.

Antenna 42 includes a conduit 50 for carrying feeds from a bottom end 52 of antenna 42 to the top end 54. One conduit 50 is used for all of the feeds. In an alternative embodiment multiple conduits could be provided. Feeds are electrically joined to a feed interface 56 at top end 54. Feed interface 56 provides signals to four helically disposed antenna elements 58. Signals are provided utilizing the quadrature established by quadrature network 46. Antenna elements 58 are positioned to form a quadrifilar helix with each element 58 being 90° apart from each adjacent element as shown in FIG. 2. Elements 58 are preferably made from a conductive foil laminated on a tubular fiberglass substrate 60. Elements 58 can be laminated to either an interior surface of substrate 60 or to an exterior surface. The width of the foil can be tailored to tune the impedance performance of the antenna. Tubular fiberglass substrate 60 can be a variety of materials providing the required mechanical support. For example, substrate 60 could be made from longitudinal dielectric strips or a dielectric material cage.

An upper section 62 of elements 58 is adjacent to top end 54 of antenna 42. Upper section 62 has a low pitch angle with respect to the antenna's axis. A lower section 64 of elements 58 is adjacent to bottom end 52. Elements 58 transition abruptly from the high pitch angle lower section 64 to the low pitch angle upper section 62 at a transition location 66 that has the same axial position along antenna 42 for all elements 58. Elements 58 are electrically joined by a tie bar 68 at bottom end 52.

Physically, antenna 42 is supported by conduit 50 which can be made from a rigid material. End caps 70 are affixed to conduit 50 to support substrate 60. End caps 70 can be provided at several axial locations along conduit 50 in order to support antenna 42. End caps 70 can also incorporate other functions such as that of the feed interface 56 or tie bar 52.

Radome 44 is made from a dielectric material such as fiberglass and has a teardrop-shaped cross section. Radome 44 is sufficiently thick to provide dielectric loading on antenna 42. In one embodiment, radome 44 is made from epoxy resin mixed with fiber glass. Radome 44 has an average thickness calculated to be approximately 10% of the wavelength of the mean operating frequency in order to properly load the antenna 42. The helical parameters are chosen to optimize performance under dielectric loading conditions present when the antenna assembly 40 is operated with a radome 44 as illustrated in FIG. 3. Radome 44 can have a different shape and be filled with other structural and electronic components.

Figure 4A:
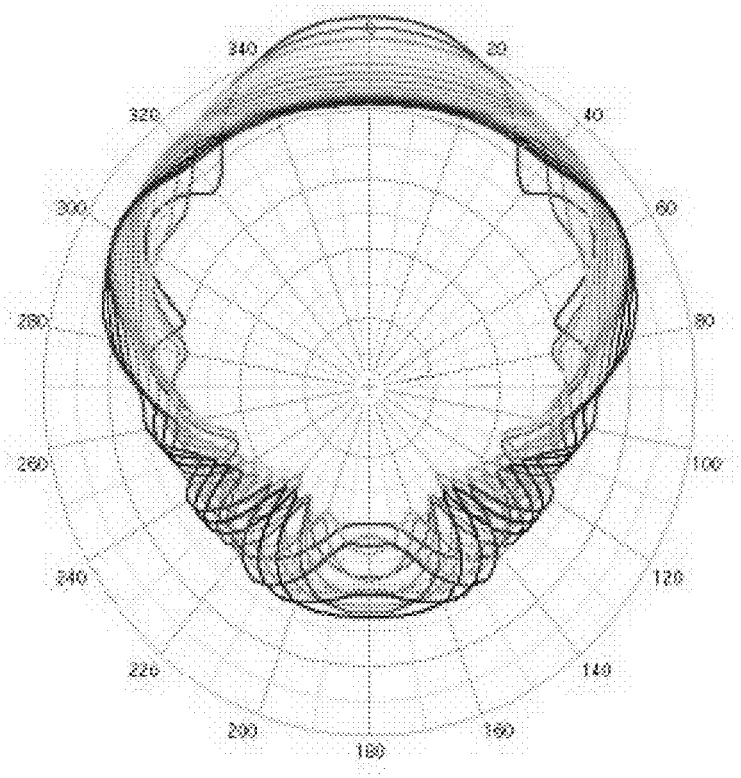
FIG. 4A provides a beam pattern of a quadrifilar antenna having a portion tuned for receiving high angle signals.
Figure 4B:
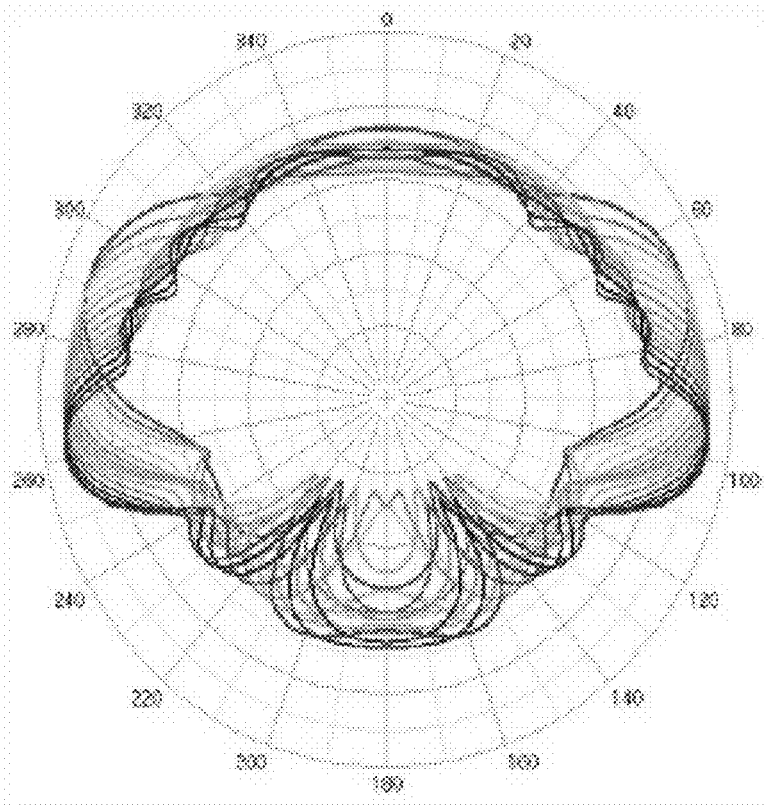
FIG. 4B provides a beam pattern of a quadrifilar antenna having a portion tuned for receiving low angle signals.

FIGS. 4A and 4B are radiation pattern plots for prior art antennas at a range of frequencies. Each trace is a different frequency. FIG. 4A shows a low pitch angle quadrifilar helix antenna. This antenna has a pitch under 45 degrees for high angle reception. As can be seen, the best gain is within 20 degrees of vertical. FIG. 4B shows a high pitch angle quadrifilar helix antenna having a pitch angle of greater than 45 degrees. Maximum radiation is within 30 degrees of the horizon. There is a significant spread among the different frequencies. It is further noted that both of these antennas have significant backfire which could be problematic in some applications.

Figure 5:
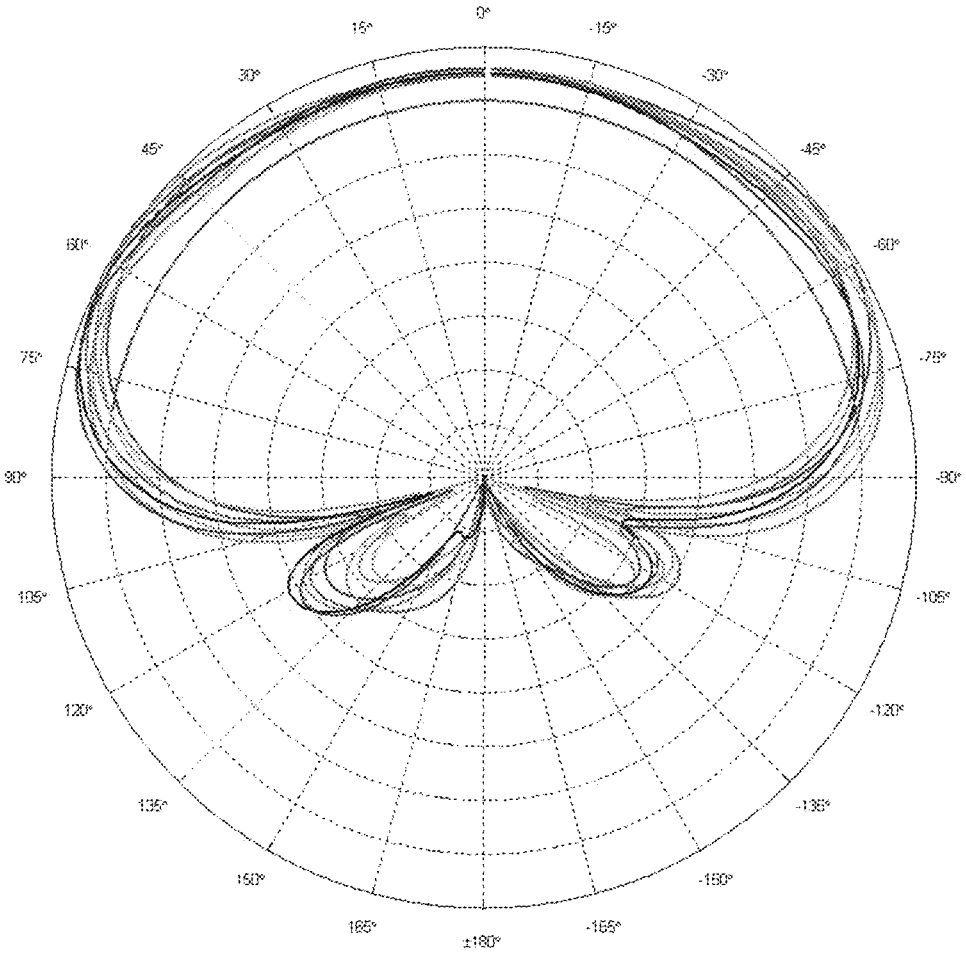
FIG. 5 provides a beam pattern of a quadrifilar antenna according to an embodiment of the invention.

FIG. 5 is a radiation pattern plot for an antenna of the current design. As before, each trace shows the pattern at a different frequency. This antenna features fairly uniform radiation from horizontal to vertical for a single antenna. Backfire is reduced which suppresses undesired reflection. It is noteworthy that the beam pattern remains fairly constant over the range of frequencies.

The top fed quadrifilar helix antenna can be made utilizing several methods. One such method may comprise steps such as providing four copper filar antenna elements, winding the filar elements in helical spiral, binding the filar elements around a cylindrical fiberglass tube. An alternative method may comprise the step of printing the filar antenna elements on a substrate with a bonding film. An alternative method may comprise the step of flame spraying the filar antenna elements on a cylindrical fiberglass tube.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. A helical quadrifilar antenna for joining to a feed comprising:

four filar elements of identical dimensions each having a first end and a second end short terminated to each of the other said filar elements, said filar elements being fashioned in the shape of a helix wherein each filar element is equally spaced relative to an axis of the helix and having a first helical pitch angle in a first region adjacent to the first end and a second distinct helical pitch angle in a second region adjacent to the second end, each said filar element directly transitioning from the first helical pitch angle to the second helical pitch angle at a transition point, said four filar elements defining a right cylindrical envelope;

a plurality of longitudinal spines joined to said four filar elements to maintain said four filar elements in a longitudinal spacing;

a plurality of end caps with each end cap joined to said spines at a longitudinal position therein and joined to said conduit to support said conduit within the right cylindrical envelope;

a conduit having feed conductors therein with each feed conductor being joined to the feed at a conduit feed end and to one of said four filar elements at the first end of the filar element, said conduit being positioned within the right cylindrical envelope with the conduit feed end proximate the second end of the four filar elements; and a radome fully enveloping the exterior of said four filar elements and made from a material and thickness that results in a dielectric load on said four filar elements.

2. The apparatus of claim 1 wherein said first helical pitch angle has a lower pitch angle than said second helical pitch angle.

3. The apparatus of claim 1 wherein said radome is made from an epoxy resin mixed with fiberglass and has a thickness of about 10% of a mean operating wavelength of the antenna.

4. The apparatus of claim 3 wherein said radome has a hydrodynamic cross-section.

5. The apparatus of claim 1 wherein:

said first helical pitch angle has a lower pitch angle than said second helical pitch angle;

said first helical pitch angle is greater than 45°; and said second helical pitch angle is less than 45°.

* * * * *